United States Patent [19]

Schär

[11] 4,293,973

[45] Oct. 13, 1981

[54] FLOOR CLEANING DEVICE

[76] Inventor: Ernst Schär, Stallikonerstrasse 73, 8903 Birmensdorf, Switzerland

[21] Appl. No.: 87,105

[22] Filed: Oct. 22, 1979

[51] Int. Cl.[3] ..... A47L 11/14

[52] U.S. Cl. ..... 15/230.17; 15/98

[58] Field of Search ..... 15/230.17, 230.19, 98, 15/180; 51/358, 388

[56] References Cited

U.S. PATENT DOCUMENTS

| | | | |
|---|---|---|---|
| 3,527,001 | 9/1970 | Kleemeier et al. | 51/358 |
| 3,728,075 | 4/1973 | Cannan | 15/98 |
| 4,114,225 | 9/1978 | Malish et al. | 15/180 |
| 4,161,050 | 7/1979 | Sasaki et al. | 15/159 A |

*Primary Examiner*—Edward L. Roberts

*Attorney, Agent, or Firm*—Frishauf, Holtz, Goodman & Woodward

[57] ABSTRACT

A matted fleece cleaning pad is supported on a number of spread-out tufts of bristles set in cavities of a holding plate, the bristles of each tuft being of different length and made of a synthetic plastic, preferably a polyamide. By this arrangement, the cleaning pad can be held springily, so that it can follow irregularities in the floor. The longer bristles are beaded at their ends by singeing, so that the cleaning pad does not fall off when the holding plate is lifted up from the floor.

12 Claims, 3 Drawing Figures

FLOOR CLEANING DEVICE

The invention relates to floor cleaning equipment of the kind having a holding plate from the lower face of which there projects a multiplicity of bristles with beaded ends distributed over the lower surface of the plate, for imparting movement to a cleaning pad.

A disadvantage of this kind of floor cleaning equipment lies in the fact that the cleaning pad moved around by the bristles cannot follow irregularities in the floor satisfactorily, and the use of a compressible intermediate layer does not afford a substantial improvement.

An object of the invention is to solve the problem of producing floor cleaning equipment of the kind described in the introduction, and to improve it in such a way that the cleaning pad can follow irregularities in the floor better. Another object of the invention is to enable the manufacture of such holding plates equipped with bristles in a simpler and more economical manner than hitherto.

SUMMARY OF THE INVENTION

Briefly, a number of tufts of bristles, distributed over and projecting from the lower face of the holding plate, have bristles of different lengths, each tuft being made up of at least one bristle bent in U-shape so as to provide legs of different length, the longer of which has a bead or head at its extremity.

Since the cleaning pad, which normally consists of a plastic fiber fleece or mat, now rests on a large number of bristles which are flexible and can also penetrate to different depths in the fleece, the cleaning pad as a whole can follow any irregularities on the floor much better. The beads, driven into the pad, hold it when the bristled plate is lifted from the floor. In addition, the manufacture of such holding plates equipped with tufts of bristles is relatively simple and can be carried out with automatic industrial machines.

BRIEF DESCRIPTION OF THE DRAWINGS

An illustrative practical embodiment of the invention is shown in the annexed drawing, in which.

DESCRIPTION OF AN ILLUSTRATIVE EMBODIMENT

Figure 1:
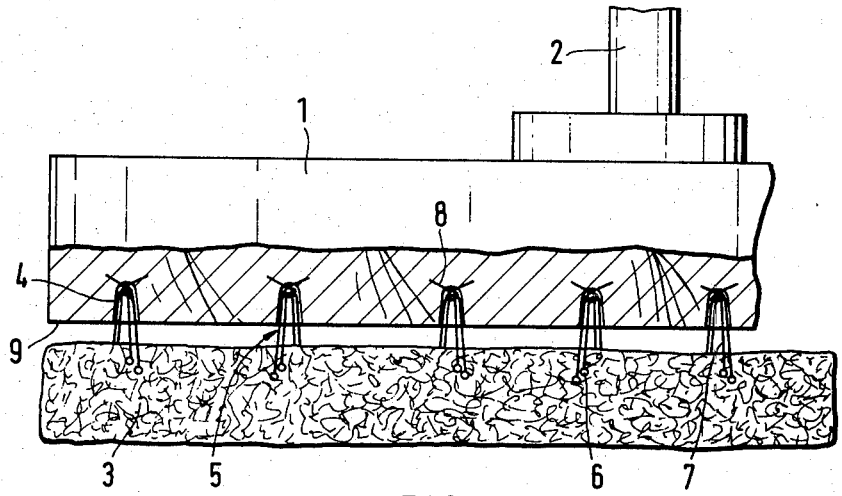
FIG. 1 is a side view of the cleaning equipment with a rotatable holding plate, partially in section.

The cleaning device shown in FIG. 1 comprises a circular holding plate 1 made of a synthetic plastic material, plywood sheet or the like. A shaft 2 is rigidly connected to the plate 1 and can be connected by a releasable coupling to a cleaning machine equipped with a drive motor and known per se, for rotating the shaft 2 and the holding plate 1 together. At a short distance from the lower face 9 of the plate a floor cleaning pad 3 is secured with the aid of bristles 7. The floor cleaning pad 3 normally consists of a synthetic plastic fiber fleece of a known type, which may, if desired, incorporate an abrasive material.

A multiplicity of tufts 5 of bristles is inserted in the holding plate 1, distributed over its entire surface. The lower face 9 of the plate contains a large number of approximately cylindrical or truncated-cone-shaped cavities or bores 4 which accommodate the tufts 5 of bristles which are secured to the base of the bore in a known way by a wire loop 8. Each tuft 5 of bristles consists preferably of three to eight, most preferably six, individual springy bristles 10 of different lengths, which are bent double at the base of the bore, and the ends of which project beyond the lower face 9 of the plate. At least one of the longer bristle ends of each tuft is provided at its outer end with a bead 6 which is preferably produced by singeing. With these end beads, the bristles penetrate into the matted cleaning pad 3 and hold the pad securely when the plate is lifted up from the floor. The cleaning pad 3 can be released from the bristles by a gentle downward tug. As shown in the drawings, there is a substantial difference in length between the unbeaded short legs and the beaded long legs of the bent-double bristles, and a smaller variation in the length of the longer beaded legs of the bristles of the tuft.

The bores, at least in the central region of the plate, have a longitudinal axis which extends at right angles to the lower face 9 of the plate. Preferably, there are more tufts of bristles per unit of area near the edge of the plate than in the center. The bores 4 are preferably tapered, with the result that the inserted bristles 7 extend along the wall of the bore so that they diverge outwards from the base of the bore, as shown in the drawing.

Figure 2:
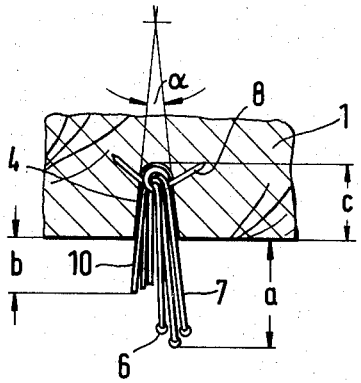
FIG. 2 is a vertical section through the axis of a bore having a tuft of bristles secured in it.
Figure 3:
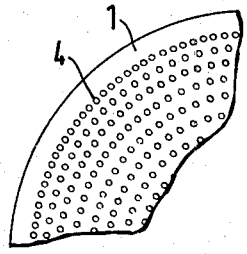
FIG. 3 is a bottom view of a broken-off portion of the holding plate shown in FIG. 1.

As can be seen in FIG. 2, the bristles are of different lengths. The length of these bristles projecting beyond the lower face 9 of the plate is preferably from 5 to 20 mm. There are typically from 100 to 400 , and preferably approximately 200 to 300 , tufts 5 of bristles per $dm^2$ of plate surface, arranged as partially shown in FIG. 3, for example. The individual bristles, which are made of plastics material, preferably of a polyamide, have a thickness of 0.4–0.8 mm, and preferably approximately 0.6 mm. Polyamide bristles are easily beaded at the tip with local application of heat, even singeing.

The depth of the bores 4 is preferably in the range from 6 to 8 mm and their diameter preferably between 2.9 and 3.3 mm. The length a of the longer bristles is about 10 mm, the length b of the shorter bristles is about 6 mm measured from where these bristles project from the face 9 of the holding plate 1. The angle $\alpha$ of the apex of the conical surface of the bore 4 is in the range from 2° to 10°, preferably about 5° to 8°.

I claim:

1. A floor cleaning device of the kind having a holding plate from the lower face of which there projects a multiplicity of bristles distributed over the lower face, at least some of which have beaded ends for carrying along a cleaning pad, having the improvement which consists in that:

said holding plate has a number of bores, open at the bottom, in each of which at least one bristle is held which is bent over to provide legs of different length and is secured by means of a loop passing through the bend of each bristle in said bore, said legs diverging outwardly from the bore in which the bristle is secured;

the longer leg of at least one bristle in each bore is beaded at its end, and a multiplicity of said bristle-equipped bores is distributed over the lower face of the holding plate and both the shorter leg and longer leg of each bristle of said bores projects on the lower face of the holding plate.

2. A floor cleaning device as defined in claim 1, in which at least two bristles are secured in each bore.

3. A floor cleaning device as defined in claim 2, in which the longer leg of each bristle is beaded at its extremity.

4. A floor cleaning device as defined in claim 3, in which the longer legs of the bristles in the same bore are of different lengths.

5. A floor cleaning device as defined in claim 1, 2, 3, or 4, in which the longer bristle legs project from the lower face of the holding plate by about 10 mm and the shorter bristle legs project from the lower face of the holding plate by about 6 mm.

6. A floor cleaning device as defined in claim 1, 2, 3 or 4, in which the length of the bristles projecting from the lower face of the holding plate is in the range from 5 to 20 mm.

7. A floor cleaning device as defined in claim 1, 2, 3 or 4, in which there are between 100 to 400 of said bores containing bristles per $dm^2$ of lower plate surface.

8. A floor cleaning device as defined in claim 7, in which there are between 200 to 300 tufts of bristles per $dm^2$ of lower plate surface.

9. A floor cleaning device as defined in claim 1, 2, 3 or 4, in which the bristles have a thickness of between 0.4 and 0.8 mm and are made of a synthetic plastic material.

10. A floor cleaning device as defined in claim 9 in which the bristles are made of a polyamide.

11. A floor cleaning device as defined in claim 1, 2, 3 or 4, in which in substantially every tuft in one of said bores the longest bristle leg projects at least twice as far from the holding plate as does the shortest bristle leg.

12. A floor cleaning device as defined in claim 1, 2, 3 or 4, in which there are more of said bristle-containing bores per unit of holding plate area near the plate edge than in the plate center.

* * * * *